US007549871B2

(12) United States Patent
Pennypacker et al.

(10) Patent No.: US 7,549,871 B2
(45) Date of Patent: Jun. 23, 2009

(54) CONNECTOR WITH DUAL COMPRESSION POLYMER AND FLEXIBLE CONTACT ARRAY

(75) Inventors: Jeffrey George Pennypacker, Corning, NY (US); Jeffrey Byron McClinton, Harrisburg, PA (US); Jason M'Cheyne Reisinger, Carlisle, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/901,906

(22) Filed: Sep. 19, 2007

(65) Prior Publication Data

US 2009/0075500 A1 Mar. 19, 2009

(51) Int. Cl.
*H01R 12/00* (2006.01)

(52) U.S. Cl. ..... 439/66

(58) Field of Classification Search ..... 439/66, 439/65, 67, 91, 591; 29/874, 848; 257/E23.06
See application file for complete search history.

(56) References Cited

U.S. PATENT DOCUMENTS 4,548,451 A * 10/1985 Benarr et al. ..... 439/85
6,358,064 B2 3/2002 Szalay et al.
6,796,810 B2 * 9/2004 DelPrete et al. ..... 439/86
6,830,460 B1 12/2004 Rathburn
6,939,143 B2 9/2005 Rathburn
6,957,963 B2 10/2005 Rathburn
6,981,879 B2 * 1/2006 Kuczynski et al. ..... 439/66
7,070,420 B1 7/2006 Wakefield et al.
7,121,839 B2 10/2006 Rathburn
7,347,698 B2 * 3/2008 Dittmann ..... 439/66
7,371,073 B2 * 5/2008 Williams ..... 439/66
2006/0160379 A1 * 7/2006 Rathburn ..... 439/66

* cited by examiner

*Primary Examiner*—Alexander Gilman

(57) ABSTRACT

A socket connector includes an insulative carrier having opposite first and second sides and a plurality of vias extending between the first and second sides. A plurality of polymer columns is held by the carrier. Each polymer column includes a first end extending from the first side of the carrier and a second end extending from the second side of the carrier. A contact array is disposed on each first and second side of the carrier. Each contact array comprises a flexible sheet having a plurality of conductive elements having contact tips proximate corresponding first and second ends of the polymer columns. The conductive elements on the first side of the carrier are electrically connected to corresponding conductive elements on the second side of the carrier through the vias in the carrier to establish electrical paths between corresponding contact tips on the first and second sides of the carrier.

25 Claims, 10 Drawing Sheets

CONNECTOR WITH DUAL COMPRESSION POLYMER AND FLEXIBLE CONTACT ARRAY

BACKGROUND OF THE INVENTION

The invention relates generally to surface mounted connectors on printed circuit boards, and more specifically, to a flexible contact system for use in socket connectors.

The ongoing trend toward smaller, lighter, and higher performance electrical components and higher density electrical circuits has led to the development of surface mount technology in the design of printed circuit boards. As is well understood in the art, surface mountable packaging allows for the connection of the package to pads on the surface of the circuit board rather than by contacts or pins soldered in plated holes going through the circuit board. Surface mount technology allows for an increased component density on a circuit board, thereby saving space on the circuit board.

The land grid array (LGA) is one type of surface mount package that has developed in response to the demand created by higher density electrical circuits for increased density of electrical connections on the circuit board. The land grid array includes an array of connections on the bottom side of the connector package. In the traditional land grid array connector, stamped and formed contacts having flexible contact beams are soldered to the circuit board using solder balls placed at contact locations on the circuit board.

While LGA technology offers the advantages of higher connection densities on the circuit board and higher package manufacturing yields which lower product cost, LGA technology is not without shortcomings. For instance, the contact beams must be compressed or deflected sufficiently to generate a required normal force on the package to reliably mate the package to the contacts. As a result, the stamped and formed contacts must have sufficient length and working range to generate the required normal force. However, a reduced height contact system is desirable for improved electrical performance.

In a prior art electrical interconnect system as disclosed in U.S. Pat. No. 7,070,420, an array of electrical contacts is held in a substrate. Each contact includes a nonconductive elastomeric element and an associated conductive element. The nonconductive element has opposite ends disposed beyond respective opposite sides of the substrate. The conductive element includes a body having opposite ends disposed exteriorly of respective opposite ends of the nonconductive elastomeric element. The opposite ends of the nonconductive elastomeric element resiliently press against the respective opposite ends of the conductive element when a force is applied to the electrical contact.

A need remains for a compressible contact system having shortened compressive contacts that can be more easily and economically manufactured, and a contact system that improves electrical performance, particularly at higher contact densities.

BRIEF DESCRIPTION OF THE INVENTION

In one embodiment, a socket connector is provided. The socket connector includes an insulative carrier having opposite first and second sides and a plurality of vias extending between the first and second sides. A plurality of polymer columns is held by the carrier. Each polymer column includes a first end extending from the first side of the carrier and a second end extending from the second side of the carrier. A contact array is disposed on each first and second side of the carrier. Each contact array comprises a flexible sheet having a plurality of conductive elements having contact tips proximate corresponding first and second ends of the polymer columns. The conductive elements on the first side of the carrier are electrically connected to corresponding conductive elements on the second side of the carrier through the vias in the carrier to establish electrical paths between corresponding contact tips on the first and second sides of the carrier.

Optionally, each said polymer column includes a primary column and a secondary column supporting the primary column. The carrier includes a plurality of apertures. The polymer column is captured by at least one of the apertures. The conductive elements are formed to displace the contact tips from the flexible sheets to provide a required contact height above the flexible sheets. Each conductive element includes a base that is directly exposed to one of the vias.

In another embodiment, a socket connector is provided that includes an insulative carrier having opposite first and second sides. The carrier includes a plurality of apertures and vias extending between the first and second sides and arranged in groups including one via and at least one aperture. Each group defines a contact location. A plurality of polymer columns is held by the carrier. Each polymer column includes a first end extending from the first side of the carrier and a second end extending from the second side of the carrier. A contact array is disposed on the first and second sides of the carrier. Each contact array includes a flexible sheet having a plurality of conductive elements having contact tips proximate corresponding first and second ends of the polymer columns. The conductive elements on the first side of the carrier are electrically connected to corresponding conductive elements on the second side of the carrier through the vias in the carrier to establish electrical paths between corresponding contact tips on the first and second sides of the carrier.

DETAILED DESCRIPTION OF THE INVENTION

Figure 1:
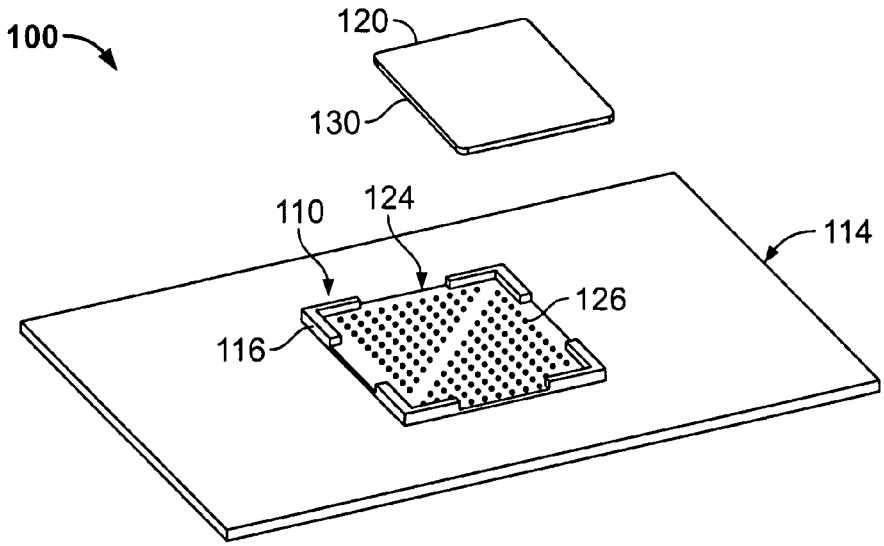
FIG. 1 is an exploded view of an electronic assembly including a socket connector formed in accordance with an exemplary embodiment of the present invention.

FIG. 1 illustrates an electronic assembly 100 including a socket connector 110 formed in accordance with an exemplary embodiment of the present invention. The socket connector 110 is mounted on a circuit board 114. An electronic package 120 is loaded onto the socket connector 110. When loaded onto the socket connector 110, the electronic package 120 is electrically connected to the circuit board 114. The electronic package 120 may be a chip or module such as, but not limited to, a central processing unit (CPU), microprocessor, or an application specific integrated circuit (ASIC), or the like. While the invention will be described in terms of a land grid array (LGA) package, it is to be understood that the following description is for illustrative purposes only and no limitation is intended thereby.

The socket connector 110 includes a housing 116 that holds a contact field 124. A plurality of compressive contact assemblies 126 are arranged in the contact field 124. The electronic package 120 has a mating surface 130 that engages the contact field 124. The contact field 124 is interposed between contact pads (not shown) on the mating surface 130 of the electronic package 120 and corresponding contact pads (not shown) on the circuit board 114 to electrically connect the electronic package 120 to the circuit board 114 as will be described.

Figure 2:
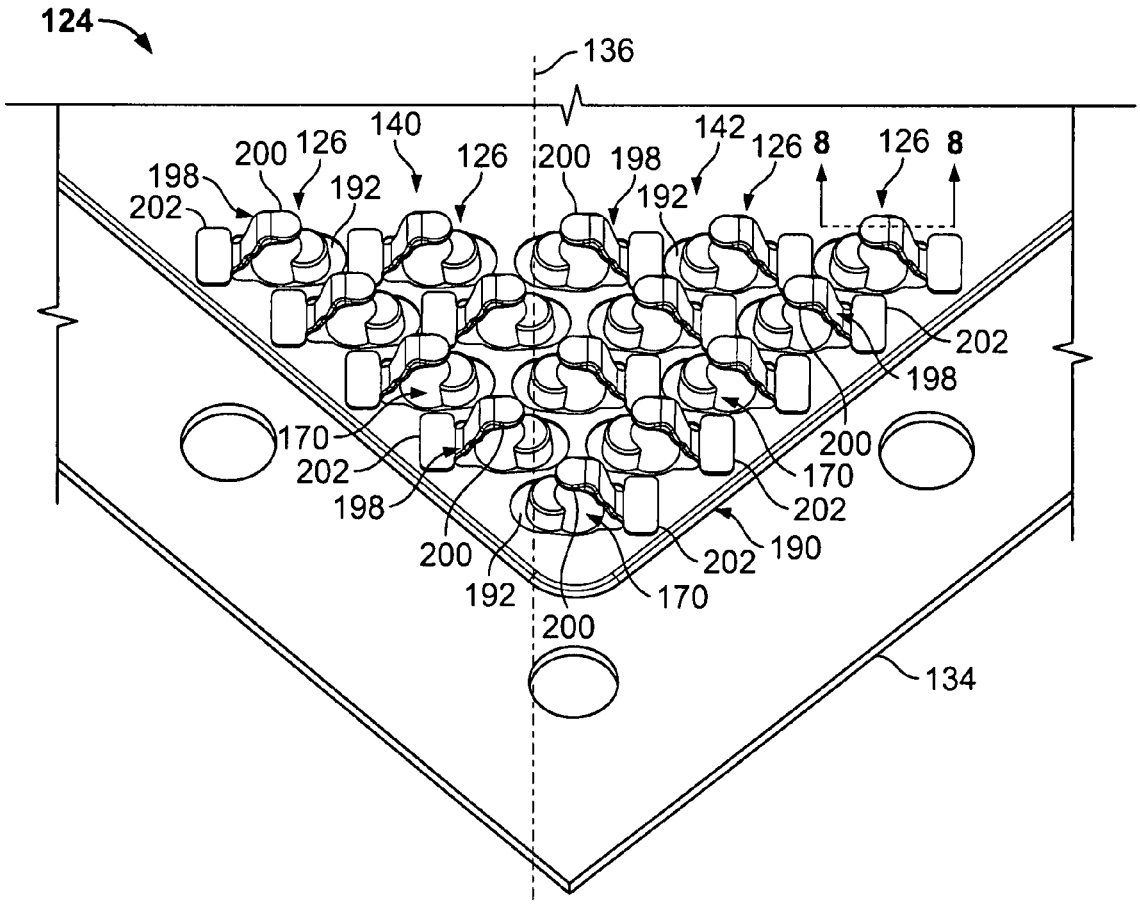
FIG. 2 is an enlarged view of a portion of a contact field formed in accordance with an exemplary embodiment of the present invention.

FIG. 2 illustrates an enlarged perspective view of a portion of a contact field 124 formed in accordance with an exemplary embodiment of the present invention. The contact field 124 includes an insulator or carrier 134 upon which the contact assemblies 126 are arranged. The contact assemblies 126 are arranged on opposite sides of a diagonal 136 that divides the contact assemblies 126 into two contact groups 140 and 142. The contact assemblies 126 on opposite sides of the diagonal 136 face each other to neutralize frictional forces on the electronic package 120 (FIG. 1) that result from the compression of the contact assemblies 126 that would otherwise tend to push the electronic package 120 toward one corner of the socket connector 110 (FIG. 1).

Figure 3:
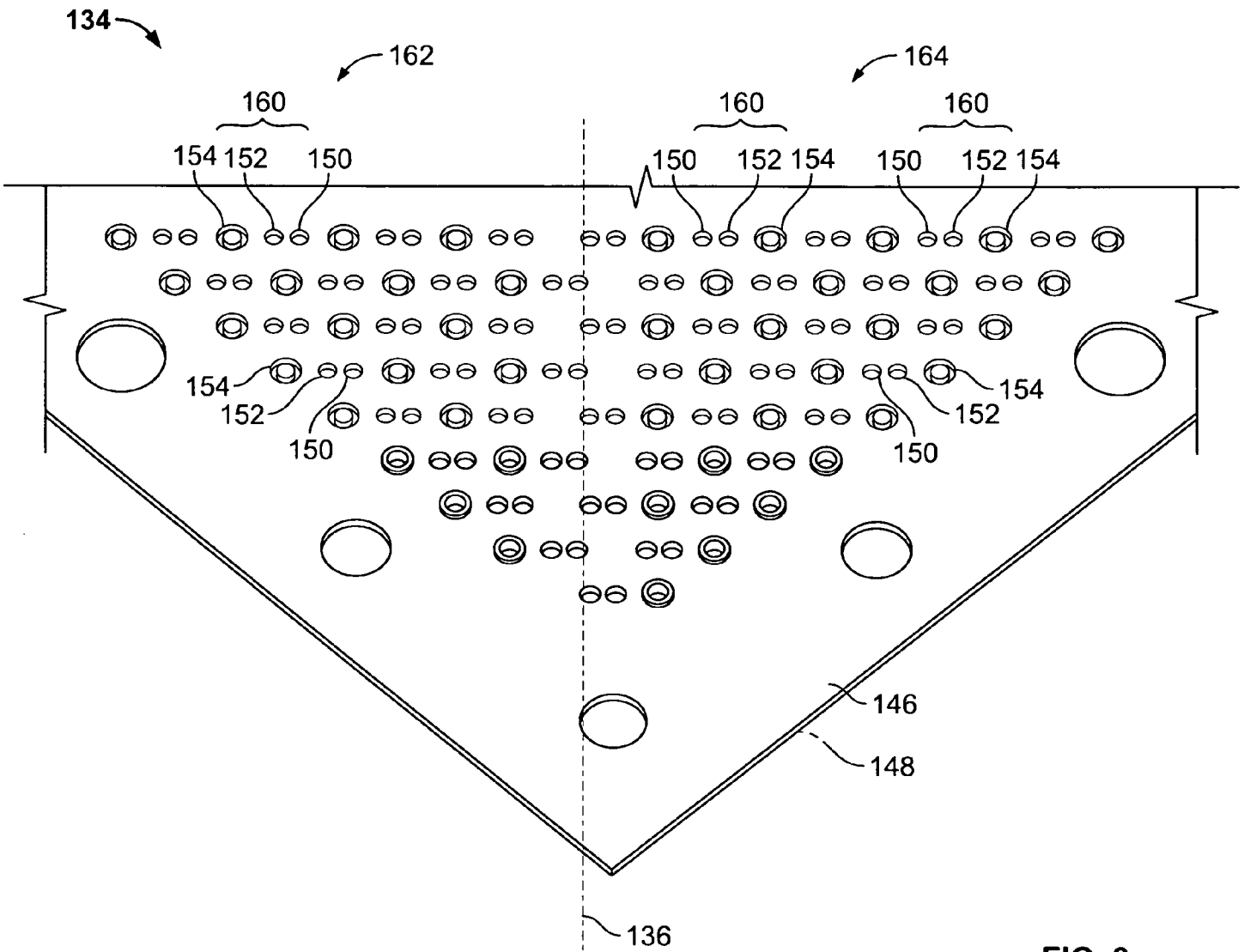
FIG. 3 is a perspective view of the carrier shown in FIG. 2.

FIG. 3 illustrates a perspective view of the carrier 134. The carrier 134 has a first side 146 and an opposite second side 148. The carrier 134 is formed from an insulative material such as FR4 which is commonly used for circuit boards, insulated stainless steel, or a polyimide material. The carrier 134 includes a plurality of first apertures 150, second apertures 152, and vias 154 arranged in groups 160 including one first aperture 150, one second aperture 152, and one via 154 and wherein each such group 160 defines a contact location on the carrier 134. In some embodiments, the first and second apertures 150 and 152 may be replaced by a single aperture, while in other embodiments, more than two apertures may be employed. The diagonal 136 divides the aperture and via groups 160 into two regions 162 and 164.

Figure 4:
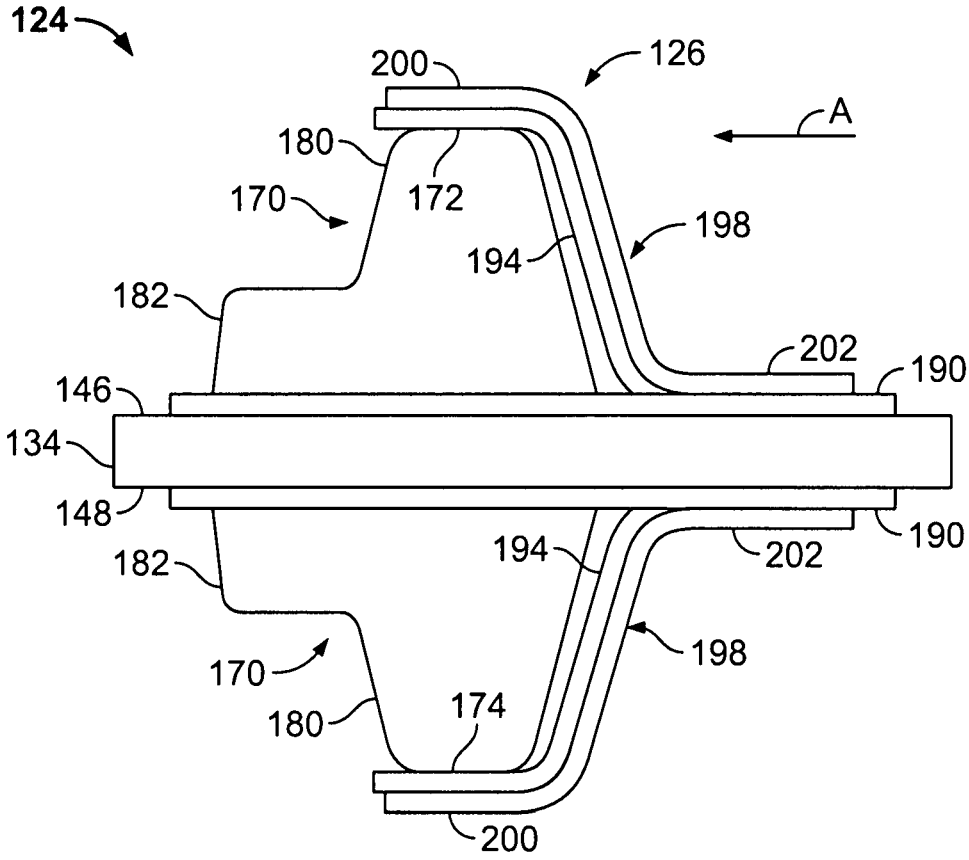
FIG. 4 is an enlarged side view of a portion of the contact field shown in FIG. 3, with a contact assembly in a relaxed state.
Figure 5:
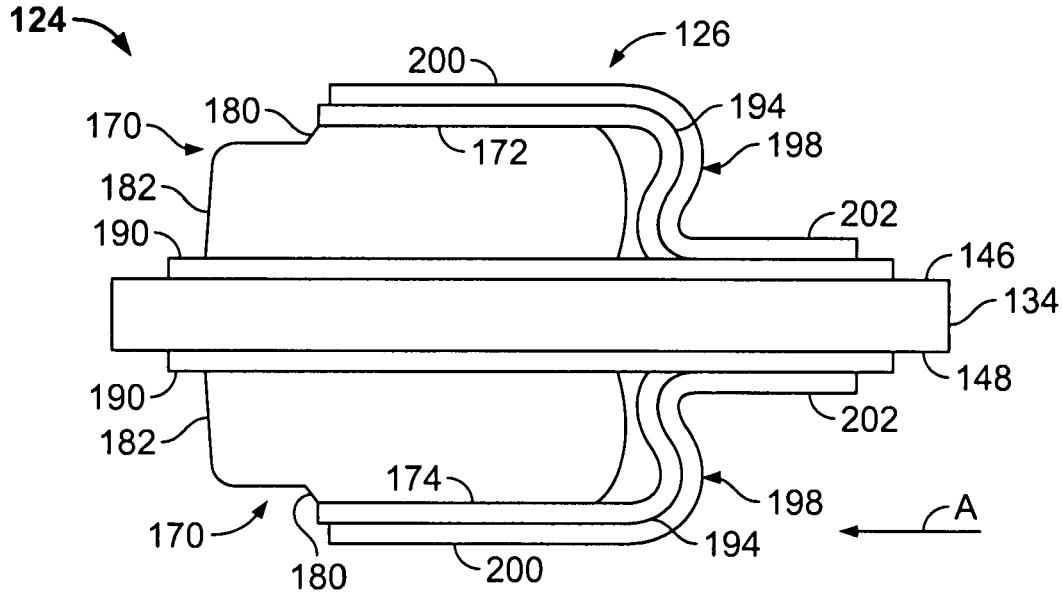
FIG. 5 is an enlarged side view of a portion of the contact field shown in FIG. 3, with a contact assembly in a compressed state.

With continued reference to FIG. 2, FIG. 4 illustrates an enlarged side view of a portion of contact field 124 with the contact assembly 126 in a relaxed state. FIG. 5 illustrates an enlarged side view of a portion of the contact field 124 with the contact assembly 126 in a compressed state. Polymer columns 170 are molded directly onto the carrier 134 and include a first end 172 that extends from the first side 146 of the carrier 134 and a second end 174 that extends from the second side 148 of the carrier 134. Both the first end 172 and the second end 174 of the polymer column 170 are compressible and as a result, the socket connector 110 (FIG. 1) may be referred to as a dual compression socket connector. In an exemplary embodiment, the polymer columns 170 are formed from a pure polymer. The polymer columns 170 provide the normal force and deflection range characteristics of the socket connector 110. Each polymer column 170 includes a primary column 180 and a secondary support column 182. The first and second ends 172 and 174 of the polymer columns 170 are located on the primary columns 180. The primary columns 180 and secondary support columns 182 are formed as a single unit. When the electronic package 120 (FIG. 1) is loaded onto the socket connector 110, the load on the contact assemblies 126 is absorbed primarily by the compression of the primary columns 180 while the secondary support columns 182 support the primary columns 180 to resist the tendency of the primary columns 180 to lean in the direction of the arrow A.

Figure 6:
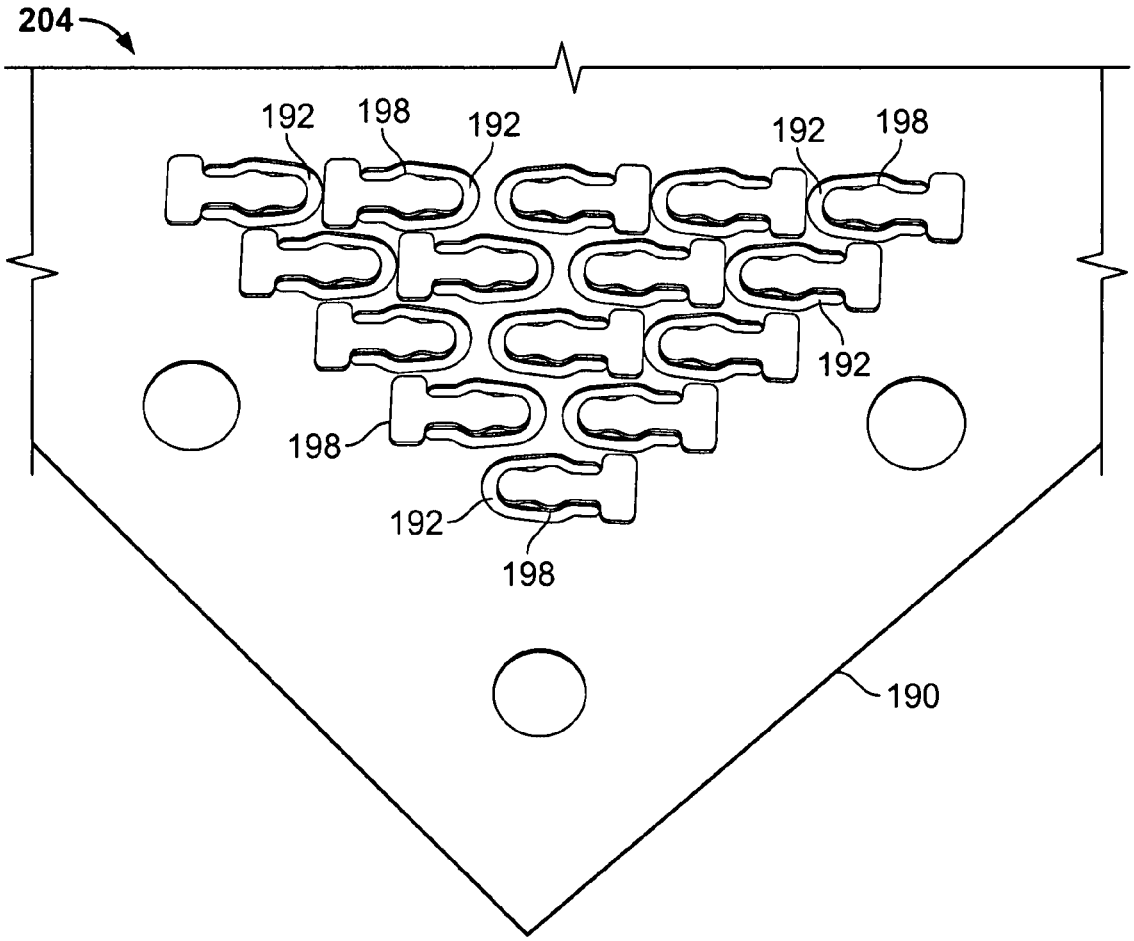
FIG. 6 illustrates a contact array with conductive elements in a flat state.
Figure 7:
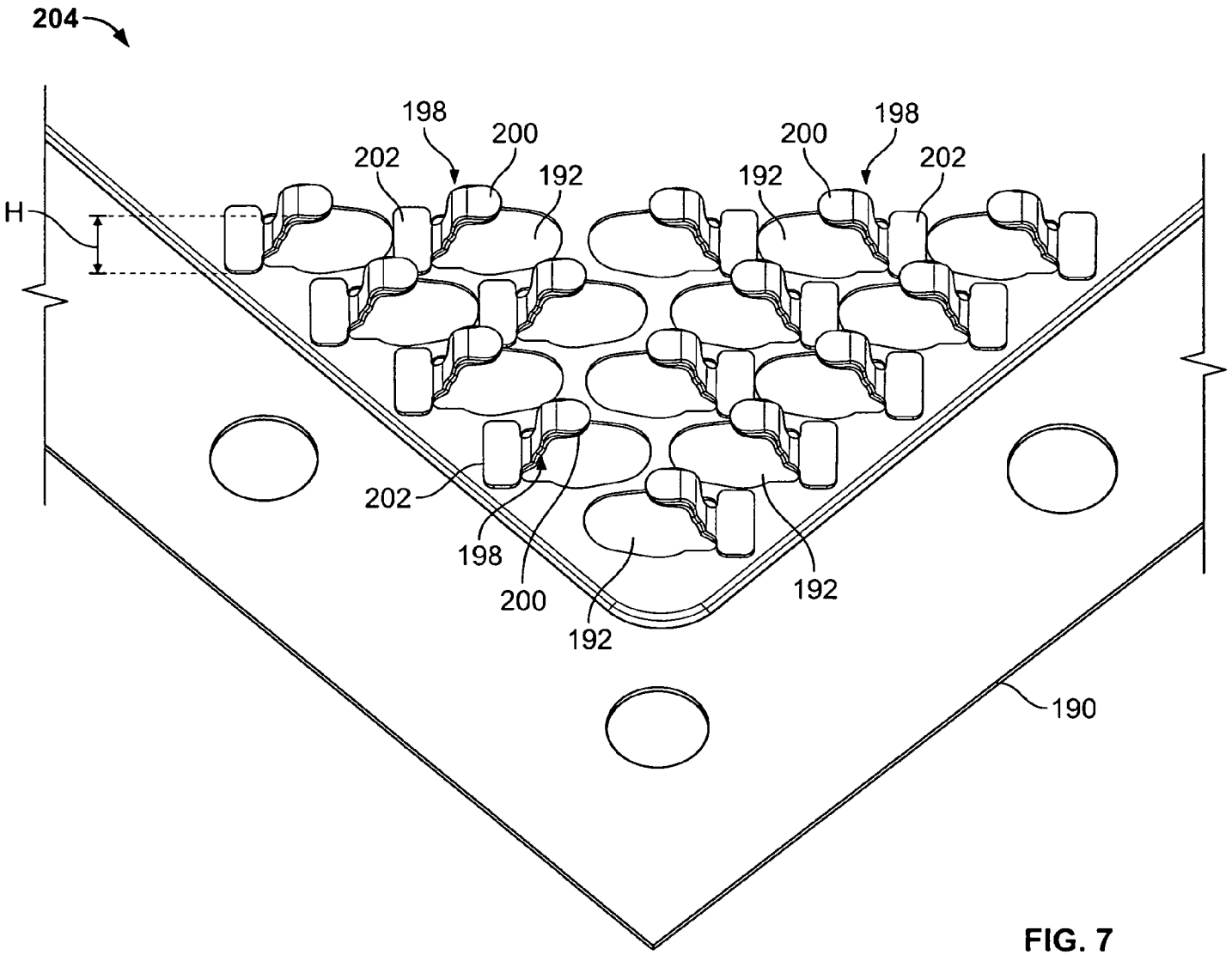
FIG. 7 illustrates the contact array shown in FIG. 6 after forming of the conductive elements.

A flexible sheet 190 is overlaid on each side 146 and 148 of the carrier 134. The flexible sheet 190 includes a cutout 192 at each contact location through which the polymer columns 170 protrude. Each flexible sheet 190 includes a strip 194 at each contact location that is positioned on the polymer columns 170. A conductive element 198 is formed on each strip 194. The conductive elements 198 include contact tips 200 positioned over the first and second ends 172 and 174 respectively of the primary polymer columns 180 and a base 202 positioned over one of the vias 154 in the carrier 134. As best shown in FIGS. 6 and 7, the flexible sheet 190 with the conductive elements 198 forms a contact array 204. When the contact arrays 204 are overlaid on the first and second sides 146 and 148 respectively, a plurality of electrical paths are established between the contact tips 200 proximate the first and second ends 172 and 174 of the polymer columns 170. In an exemplary embodiment, the flexible sheets 190 are fabricated from a flexible polyimide material. One such polyimide material is commonly known as Kapton® which is available from E. I. du Pont de Nemours and Company.

FIG. 6 illustrates the contact array 204 with the conductive elements 198 in a flat state. FIG. 7 illustrates the contact array 204 after forming of the conductive elements 198. In an exemplary embodiment, the conductive elements 198 comprise conductive traces that are etched onto the flexible sheet 190 and may be formed of copper. More specifically, in the exemplary embodiment, the conductive elements 198 are formed of dead soft copper. The flexible sheet 190 provides a carrier for the conductive elements 198 and, in an exemplary embodiment, also isolates the polymer columns 170 from the contact pads (not shown) on the electronic package 120 (FIG. 1) and the circuit board 114 (FIG. 1). The cutouts 192 are etched or cut around the conductive elements 198 leaving the strips 194 (FIG. 4) to which the conductive elements 198 are adhered. The cutouts 192 are sized to receive the polymer columns 170 (see FIG. 2) after the conductive elements 198 are formed to their final contour as shown in FIG. 7. The conductive elements 198 are formed to elevate the contact tips 200 from the bases 202. More specifically, the conductive elements 198 are formed to displace the contact tips 200 from the flexible sheet 190 to thereby provide a required contact height H above the flexible sheet 190 so that the polyimide strips 194 and the tips 200 of the conductive elements 198 rest on the first or second ends 172 and 174 of the primary polymer columns 180 (FIG. 4) when the flexible sheet 190 is laid over the carrier 134 with the polymer columns 170.

Figure 8:
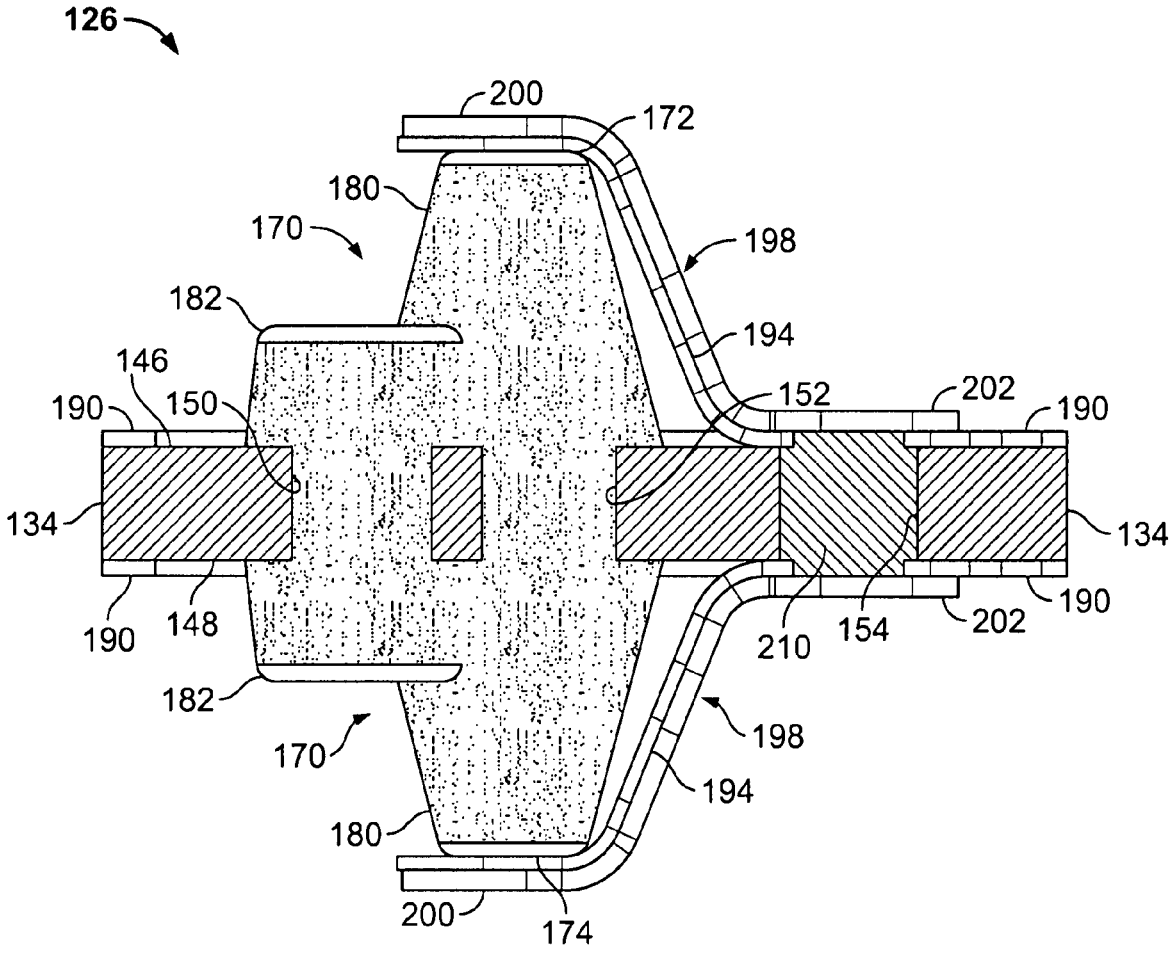
FIG. 8 is a cross-sectional view of the contact assembly taken along the line 8-8 shown in FIG. 2.

FIG. 8 illustrates a cross-sectional view of the contact assembly 126 taken along the line 8-8 in FIG. 2. When the polymer column 170 is molded onto the carrier 134, the primary column 180 and the secondary support columns 182 are captured by the apertures 152 and 150 respectively. The conductive elements 198 on the first side 146 of the carrier 134 are electrically connected to corresponding conductive elements 198 on the second side 148 of the carrier 134 through the vias 154 in the carrier. The material in the polyimide sheet 190 is etched away under the base 202 of the conductive elements 198 at the location of the via 154 to expose the base 202 of the conductive elements 198 directly to the via 154 through which an electrical connection is made. The relatively short conductive path that results enhances high speed electrical performance. As illustrated in FIG. 8, the via 154 is filled with a conductive epoxy 210. Alternatively, the bases 202 may be interconnected by other known methods such as, for instance, plating the via 154 or using a solder wire connection, etc.

Figure 9:
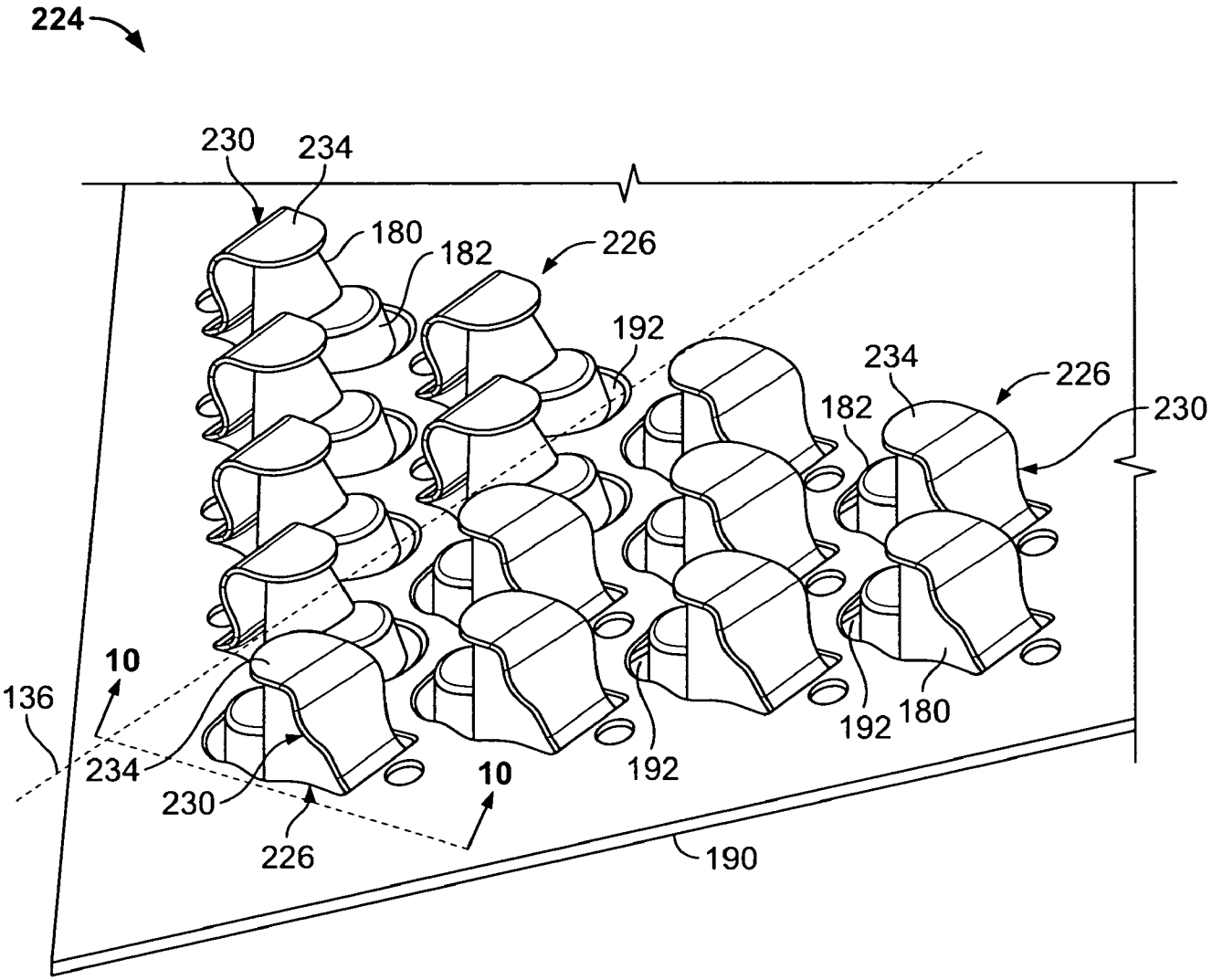
FIG. 9 is a perspective view of a portion of a contact field formed in accordance with an alternative embodiment of the present invention.
Figure 10:
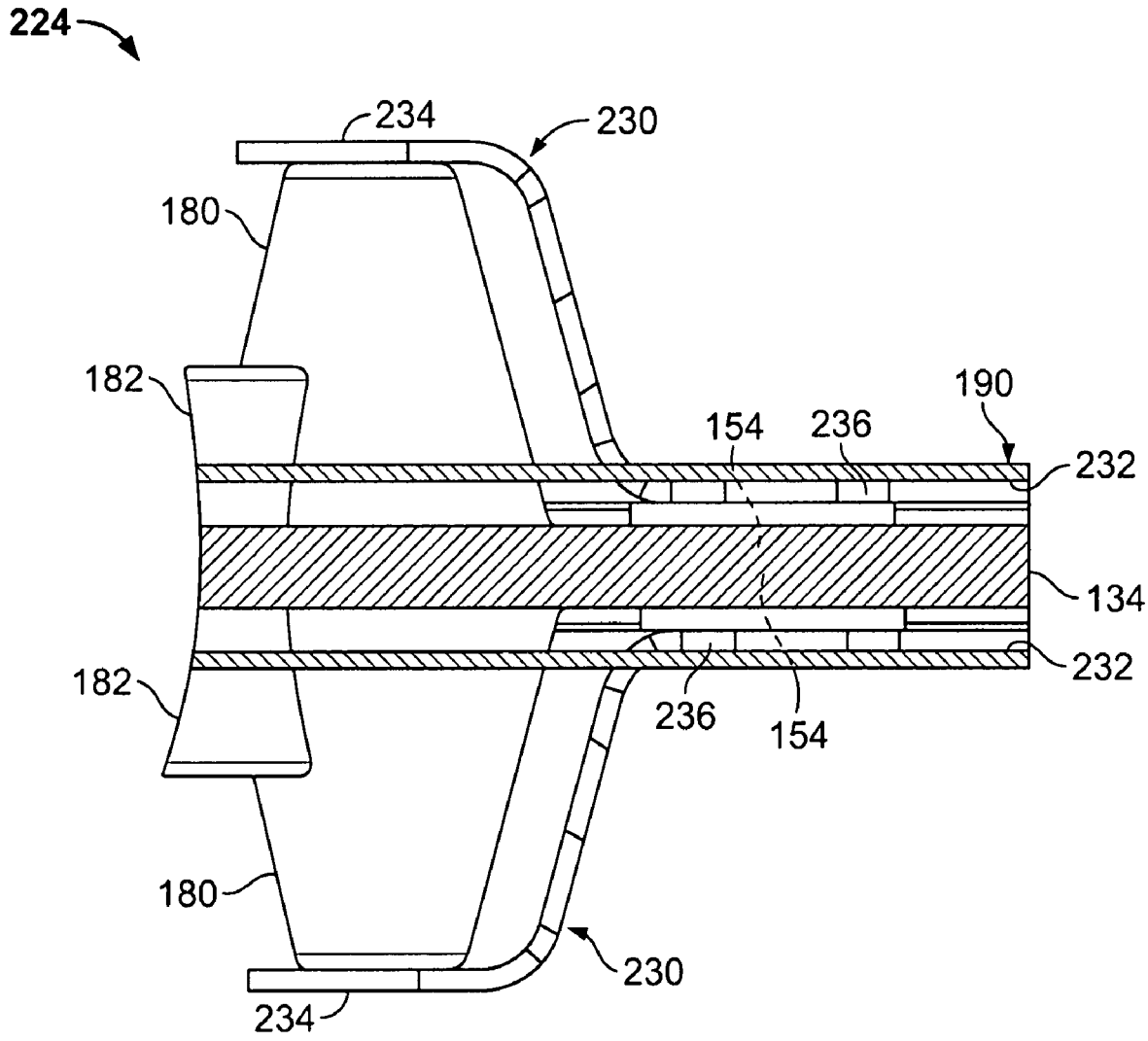
FIG. 10 is across section through the contact field shown in FIG. 9 taken along the line 10-10.

FIG. 9 illustrates a perspective view of a portion of a contact field 224 formed in accordance with an alternative embodiment of the present invention. FIG. 10 is across section through the contact field 224 taken along the line 10-10 in FIG. 9. The contact field 224 includes the carrier 134 upon which contact assemblies 226 are arranged. The contact assemblies 226 are arranged on opposite sides of the diagonal 136. The contact assemblies 226 include the polymer columns 180 and 182 and the flexible sheets 190 previously described. The contact field 224 is similar to the contact field 124 previously described and shown in FIG. 2 with the exception that the flexible sheets 190 are inverted or flipped over when laid over the carrier 134 and polymer columns 180, 182 conductive elements are applied. That is, the contact field 224 includes conductive elements 230 that are applied to an underside 232 of the flexible sheets 190 adjacent the carrier 134.

Each conductive element 230 includes a contact tip 234 and a base 236. After the conductive elements 230 are applied to the flexible sheet 190, the conductive elements 230 are folded back through the cutouts 192 and formed or contoured to lay over the polymer columns 180. In this embodiment, flexible sheet material is removed at least from the contact tip 234 to provide a conductive surface for electrical engagement with the contact pads (not shown) on the circuit board 114 (FIG. 2) and the electronic package 120 (FIG. 2). The base 236 is located over one of the vias 154 (see also FIG. 8) in the carrier 134 for electrical connectivity with the corresponding conductive element 230 through the via 154 using methods previously described.

Figure 11:
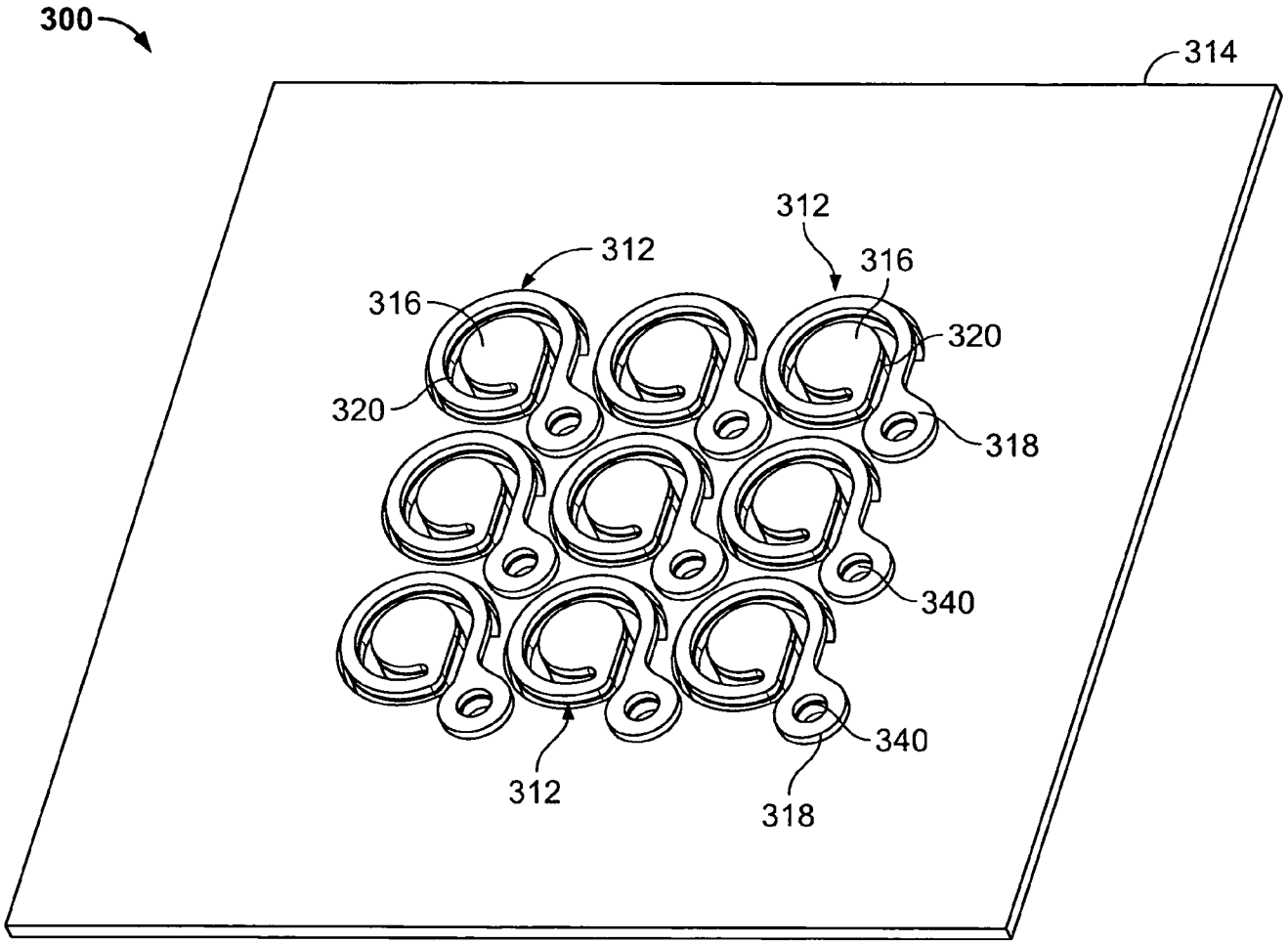
FIG. 11 illustrates an alternative embodiment of a contact array with conductive elements in a flat state.
Figure 12:
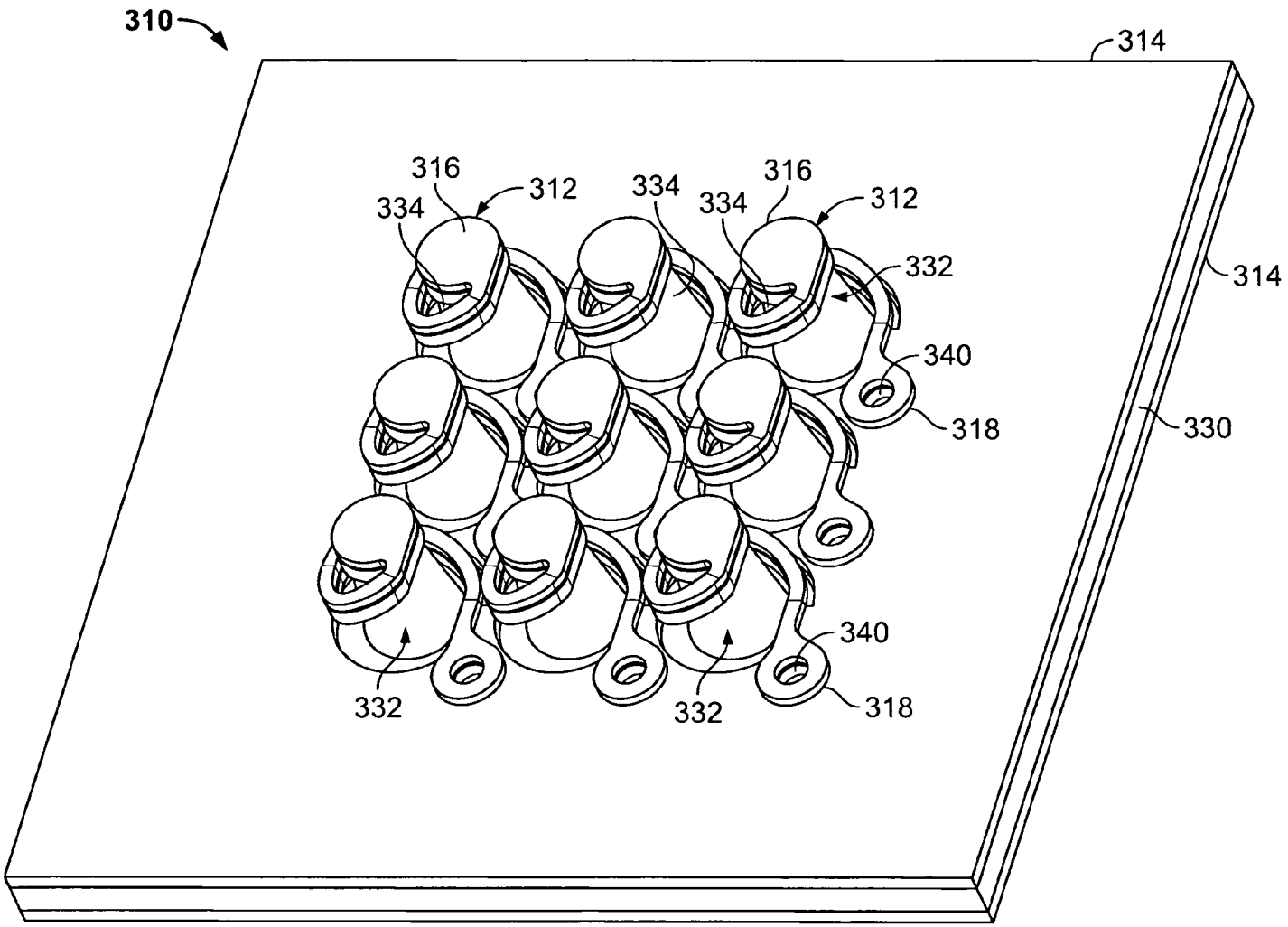
FIG. 12 illustrates a contact field including the contact array shown in FIG. 11.

FIG. 11 illustrates a contact array 300 formed in accordance with another alternative embodiment of the present invention. FIG. 12 illustrates a contact field 310 including the contact array 300. The contact array 300 includes conductive elements 312 that are formed on a flexible sheet 314 of a polyimide material. In FIG. 11, the conductive elements 312 are in a flat state and have a spiral or helical geometry. It is contemplated that the conductive elements 312 may also take other shapes within the spirit of the invention. In an exemplary embodiment, the conductive elements 312 are conductive traces etched onto the flexible sheet 314 and may be formed of copper. Each conductive element 312 includes a contact tip 316 and a base 318. Spiral cutouts 320 are etched or cut around the conductive elements 312.

The contact field 310 includes an insulator or carrier 330 that has a plurality of polymer columns 332 molded thereon. The carrier 330 and polymer columns 332 are similar to the carrier 134 and polymer columns 170 previously described and shown in FIG. 2. In FIG. 12, the conductive elements 312 are formed and a contact array 300 is laid over each side of the carrier 330 so that the contact tips 316 of the conductive elements 312 are located over ends 334 of the polymer columns 332. The contact tips 316 are positioned to engage contact pads (not shown) on the circuit board 114 (FIG. 1) and the electronic package 120 (FIG. 1) when the contact field 310 is interposed therebetween. The cutouts 320 are configured so the conductive elements 312 spiral around the polymer columns 332. As illustrated, the bases 318 include apertures 340 that are positioned over vias (not shown) in the carrier 330 and the flexible sheet 314. Alternatively, the bases 318 may not include apertures 340, in which case, an underside of each base 318 is exposed to the vias in the carrier 330 and flexible sheet 314. The bases 318 of the conductive elements 312 on opposite sides of the carrier 330 at each contact location are electrically interconnected as previously described.

The embodiments thus described provide a reduced height dual compression LGA socket connector. The socket can be easily and economically manufactured and provides improved high speed electrical performance, particularly at higher contact densities. Columns of a pure polymer are molded to a non-conductive carrier. Copper conductive elements, which may be conductive traces, are etched onto a polyimide sheet to form a flexible contact array. The entire flexible contact array is laid over the polymer columns and the carrier for improved manufacturability. A short electrical path enhances electrical performance.

While the invention has been described in terms of various specific embodiments, those skilled in the art will recognize that the invention can be practiced with modification within the spirit and scope of the claims.

What is claimed is:

1. A socket connector comprising:

an insulative carrier having opposite first and second sides and a plurality of vias extending between said first and second sides;

a plurality of polymer columns held by said carrier, each said polymer column including a primary column extending along a longitudinal direction away from said first side of said carrier to a first end, and a secondary column offset from said primary column in a direction transverse to said longitudinal direction, said secondary column supporting said primary column; and a contact array disposed on said first side of said carrier, said contact array comprising a flexible sheet and individual contacts having contact tips proximate corresponding said first ends of said polymer columns and wherein said contacts have contact bases electrically connected to said vias in said carrier.

2. The socket connector of claim 1, wherein said carrier includes a plurality of apertures and said polymer column is captured by at least one of said apertures.

3. The socket connector of claim 1, wherein said contacts are formed to displace said contact tips from said flexible sheet to provide a required contact height above said flexible sheet.

4. The socket connector of claim 1, wherein said vias are open plated vias.

5. The socket connector of claim 1, wherein said vias are filled with a conductive material.

6. The socket connector of claim 1, wherein said contacts include bases that are directly exposed to said vias.

7. The socket connector of claim 1, wherein said polymer columns comprise columns of a pure polymer.

8. The socket connector of claim 1, wherein said individual contacts are etched and formed on said flexible sheet.

9. The socket connector of claim 1, wherein said flexible sheet includes a cutout proximate each said contact and said polymer columns are disposed within said cutouts.

10. The socket connector of claim 9, wherein said contacts are folded through said cutouts between said first ends of said polymer columns and said vias.

11. The socket connector of claim 1, wherein said primary columns comprise second ends extending from said second side of said carrier, said contact array is disposed on said first and second sides of said carrier, and said contact bases of said contact array on said first side of said carrier are electrically connected to corresponding said contacts on said second side of said carrier through said vias in said carrier to establish electrical paths between corresponding contact tips on said first and second sides of said carrier.

12. The socket connector of claim 1, wherein the polymer columns have a stepped profile.

13. A socket connector comprising:

an insulative carrier having opposite first and second sides, said carrier including a plurality of apertures and vias extending between said first and second sides and arranged in groups including one via and at Least one aperture, and wherein each said group defines a contact location;

a plurality of polymer columns held by said carrier, each said polymer column including a primary column and a secondary column, said primary column extending in a longitudinal direction from said first side of said carrier to a first end, said secondary column offset from said primary column in a direction transverse to said longitudinal direction; and a contact array disposed on said first side of said carrier, said contact array comprising a flexible sheet including a plurality of conductive elements having contact tips proximate corresponding said first end of said polymer columns and wherein said conductive elements on said first side of said carrier are electrically connected to said vias in said carrier.

14. The socket connector of claim 13, wherein said primary columns absorb a compressive force on said socket connector and said secondary columns laterally support said primary columns.

15. The socket connector of claim 13, wherein said flexible sheet comprises a flexible polyimide material.

16. The socket connector of claim 13, wherein said conductive elements are formed to displace said contact tips from said flexible sheet to provide a required contact height above said flexible sheet.

17. The socket connector of claim 13, wherein said vias are open plated vias.

18. The socket connector of claim 13, wherein said vias are filled with a conductive material.

19. The socket connector of claim 13, wherein each said conductive element includes a base that is directly exposed to one of said vias.

20. The socket connector of claim 13, wherein said polymer columns comprise columns of a pure polymer.

21. The socket connector of claim 13, wherein said conductive elements are etched and formed on said flexible sheet.

22. The socket connector of claim 13, wherein said primary columns comprise second ends extending from said second side of said carrier, said contact array is disposed on said first and second sides of said carrier, and said contact bases of said contact array on said first side of said carrier are electrically connected to corresponding said conductive elements on said second side of said carrier through said vias in said carrier to establish electrical paths between corresponding contact tips on said first and second sides of said carrier.

23. The socket connector of claim 13, wherein the polymer columns have a stepped profile.

24. The socket connector of claim 13, wherein said flexible sheet includes a cutout proximate each said conductive element and one of said polymer columns is disposed within said cutout.

25. The socket connector of claim 24, wherein said conductive elements are folded through said cutouts between said first ends of said polymer columns and said vias.

* * * * *